United States Patent [19]

Fohst

[11] Patent Number: 4,926,570

[45] Date of Patent: May 22, 1990

[54] SHOE INNER SOLE, PARTICULARLY INSOLE OR WELT

[75] Inventor: Manfred Fohst, Dierdorf, Fed. Rep. of Germany

[73] Assignee: Lohmann GmbH & Co. KG, Neuwied, Fed. Rep. of Germany

[21] Appl. No.: 222,098

[22] Filed: Jul. 20, 1988

[30] Foreign Application Priority Data

Jul. 22, 1987 [DE] Fed. Rep. of Germany ..... 3724327

[51] Int. Cl.[5] ..... A43B 13/38

[52] U.S. Cl. ..... 36/43; 361/224

[58] Field of Search ..... 36/1, 43; 57/901; 128/382, 383; 139/425 R; 361/223, 224

[56] References Cited

U.S. PATENT DOCUMENTS

| | | | |
|---|---|---|---|
| 3,007,083 | 10/1961 | MacQuaid | 36/43 |
| 3,288,175 | 11/1966 | Valko | 139/425 R |
| 3,898,538 | 8/1975 | Dalton | 361/224 |
| 3,993,932 | 11/1976 | Weigl | 361/224 |
| 4,150,418 | 4/1979 | Berbeco | 361/224 |

FOREIGN PATENT DOCUMENTS

| | | | |
|---|---|---|---|
| 1043088 | 11/1978 | Canada | 57/901 |
| 0004452 | 2/1978 | Japan | 139/425 R |

*Primary Examiner*—Werner H. Schroeder
*Attorney, Agent, or Firm*—Kalish & Gilster

[57] ABSTRACT

The invention relates to a shoe inner sole, particularly an insole or welt for working or safety shoes, with a binder and a non-woven fabric optionally containing fillers, for preventing electric charges to the shoe wearer, the non-woven fabric containing a fibrous blend with between approximately 1 to 10% by weight of electrically conductive fibres.

10 Claims, 1 Drawing Sheet

SHOE INNER SOLE, PARTICULARLY INSOLE OR WELT

Figure 1:
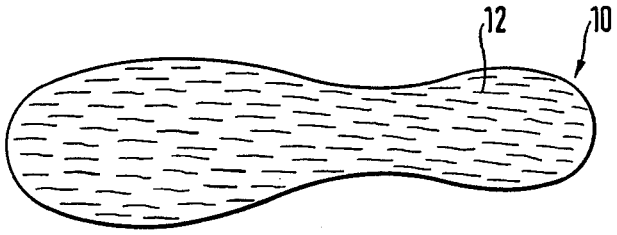

The invention relates to a shoe inner sole, particularly an insole or welt for shoes, such as working or safety shoes, with a binder and a non-woven fabric optionally containing fillers.

In connection with insoles, particularly in the case of shoes with plastic soles such as are generally worn, a problem exists in electric power stations, computer centres, electronics installations, chemical laboratories, etc. in that electric charges easily occur when the plastic soles come into contact with plastic-containing floors, such as linoleum-like floor coverings and synthetic fibre-containing carpets.

These charges can give rise to considerable charge quantities which, in the case of sensitive electrical appliances and components, can lead to faults or even to the destruction of sensitive components. In the case of chemical laboratories the discharges resulting from such charges can lead to the formation of sparks, which can ignite flammable materials.

In order to avoid the charging of floor coverings and other systhetic fibre-containing materials it has already been proposed to incorporate conductive fibres into them. Thus, it is proposed in DE-OS 20 16 403 for the purpose of preventing the static charging of carpets, to use a fundamental fabric for tufting carpets and needled fabrics, which has filamentary or fibrous yarns formed from a fibre blend with metal or metalized fibres.

German patent 19 17 587 describes the addition of metal and preferably steel fibres to a laminate made from various fibrous materials.

In order to prevent the static charging of turntables in record players, German patent 24 57 542 proposes the incorporation of metal and in particular steel fibres into the felt covering such turntables.

Conductive cloths formed from a fabric with a metal fibre content for filtering purposes are described in "Textile Institute and Industry", vol. 7, 1972, p. 199.

However, to prevent the charging of personnel, it is not always possible to assume that the floor is antistatically finished, or to allow only leather soles, as has been the case with existing shoes for such purposes. In particular, leather no longer meets modern requirements.

The problem of the present invention is to so finish the shoes that a charge can be avoided.

According to the invention this problem is solved by a shoe inner sole, particularly an insole or welt for working or safety shoes, with a binder and a non-woven fabric optionally containing fillers, in which the non-woven fabric has a fibrous blend with between approximately 1 to 10% by weight of electrically conductive fibres.

The non-woven fabrics which can be used are needled fabrics, tangled fibre fabrics, etc. The fibrous blend of the non-woven fabric can have synthetic and/or natural and/or semisynthetic fibres. As synthetic fibres have proved advantageous e.g. polyester fibres, nylon fibres, etc. and mixtures thereof, particularly due to their high stability and durability, but in part due to their favourable price.

The electrically conductive fibres used preferably contain at least one readily conducting, flexible metal, such as copper, iron or aluminium, or are fibres covered with a conductive metal. It is also possible to use elementary carbon.

The conductive fibres can have a titre of 1 to 18 and preferably 3 to 12 dtex.

A standard conductive fibre staple length is 20 to 80 mm.

In the case of an inventive sole the volume resistance through the sole in the case of an applied voltage of 100 V can be below or in the range of $1\times10^5$ ohm and preferably equal to or smaller than $1\times10^4$ ohm.

The binder is preferably hydrophobic and e.g. nitrile-butadiene rubber and/or styrene-butadiene-rubber latex is suitable.

It is also preferable for the sole to contain a bactericidal agent for foot hygiene and for material protection purposes.

Further features and advantages of the invention can be gathered from the following description of a non-limitative embodiment and with reference to the drawings, wherein show:

FIG. 1: a plan view of an inventive sole.

Figure 2:
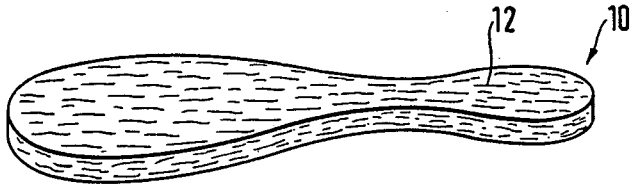

FIG. 2: A perspective view of the sole of FIG. 1.

As shown in FIG. 1 sole 10 has a non-woven fabric, which is traversed by thin steel fibres 12.

FIG. 2 shows that the steel fibres 12 extend through the entire sole thickness.

An example concerning the production of the inventive sole is now provided:

EXAMPLE

A needled non-woven fabric formed from a mixture of polypropylene and polyester fibres, as well as 2% by weight of steel fibres with a thickness of approximately 9 dtex and a length of approximately 40 mm, weighing 350 to 550 g/m$^2$ and having a thickness of 2 to 3 mm is impregnated with 100% by weight of a mixture of nitrile-butadiene rubber and styrene-butadiene rubber latex, dried at 150° C. and vulcanized. The binder-reinforced fabric is then abraded on one side, the abraded side giving a foot-friendly surface. The material is used in per se known manner for producing an insole or welt and has a resistance of $10^5$ ohm when a voltage of 100 V is applied over the sole thickness.

I claim:

1. Shoe inner sole, particularly insole or welt for working or safety shoes, with a binder and a non-woven fabric as well as antistatic additives, wherein the non-woven fabric comprises a mixture of fibers with between approximately 1 to 10% by weight of electrically conductive staple fibers.

2. Shoe inner sole according to claim 1, wherein the mixture of fibers of the non-woven fabric contains at least one fiber selected from the group consisting of synthetic, natural and semisynthetic fibers.

3. Shoe inner sole according to claim 1, wherein the conductive fibers contain at least one metal.

4. Shoe inner sole according to claim 1, wherein the conductive fibers have a titre of 1 to 18 and preferably 3 to 12 dtex.

5. Shoe inner sole according to claim 1, characterized in that the conductive fibers have a staple length of 20 to 80 mm.

6. Shoe inner sole according to claim 1, wherein the volume resistance through the sole when a voltage of 100 V is applied is below or in the range $1\times10^5$ ohm and is preferably equal to or below $1\times10^4$ ohm.

7. Shoe inner sole according to claim 1 wherein the binder is hydrophobic.

8. Shoe inner sole according to claim 1 wherein the binder contrains nitrile-butadiene rubber and/or styrene-butadiene rubber latex.

9. Shoe inner sole according to claim 1 wherein the sole contains a bactericidal agent.

10. Shoe inner sole according to claim 1, and further containing fillers.

* * * * *

US004926570B1

REEXAMINATION CERTIFICATE (2818th)

United States Patent [19]

Fohst

[11] B1 4,926,570

[45] Certificate Issued Mar. 19, 1996

[54] SHOE INNER SOLE, PARTICULARLY INSOLE OR WELT

[75] Inventor: Manfred Fohst, Dierdorf, Germany

[73] Assignee: Lohmann GmbH & Co. KG, Neuwied, Germany

Reexamination Request:
No. 90/003,457, Jun. 6, 1994

Reexamination Certificate for:

| | |
|---|---|
| Patent No.: | **4,926,570** |
| Issued: | **May 22, 1990** |
| Appl. No.: | **222,098** |
| Filed: | **Jul. 20, 1988** |

[30] Foreign Application Priority Data

Jul. 22, 1987 [DE] Germany ..... 3724327

[51] Int. Cl.[6] ..... A43B 13/38

[52] U.S. Cl. ..... 36/43; 361/224

[58] Field of Search ..... 36/1, 43; 57/901; 139/425 R; 361/222, 224

[56] References Cited

U.S. PATENT DOCUMENTS 3,288,175 11/1966 Valko .

3,836,422 9/1974 Bischoff .

FOREIGN PATENT DOCUMENTS

| | | |
|---|---|---|
| 3146179A1 | 6/1983 | Germany . |
| 1490116 | 10/1977 | United Kingdom . |
| 1496009 | 12/1977 | United Kingdom . |
| 1602198 | 11/1981 | United Kingdom . |

OTHER PUBLICATIONS

Carbon–Incorporated Viscose Fibers, by Dr. J. Marini, Dr. H. P. Ruf and A. Wimmer, published Jun., 1987.

Minutes of the Public Session of the 2nd Panel (Nullity Panel II) of the German Federal Patent Court in the Nullity Suit, Nov. 4, 1993 (and translation).

Excerpt p. 1355 of Manuale Di Tecnologia Tessile (and translation).

Imperial Chemical Industrie publication entitled "Adding strength and performance" and subtitled Static Conductive Epitropic Fibre From ICI.

*Primary Examiner*—Ted Kavanaugh

[57] ABSTRACT

The invention relates to a shoe inner sole, particularly an insole or welt for working or safety shoes, with a binder and a non-woven fabric optionally containing fillers, for preventing electric charges to the shoe wearer, the non-woven fabric containing a fibrous blend with between approximately 1 to 10% by weight of electrically conductive fibres.

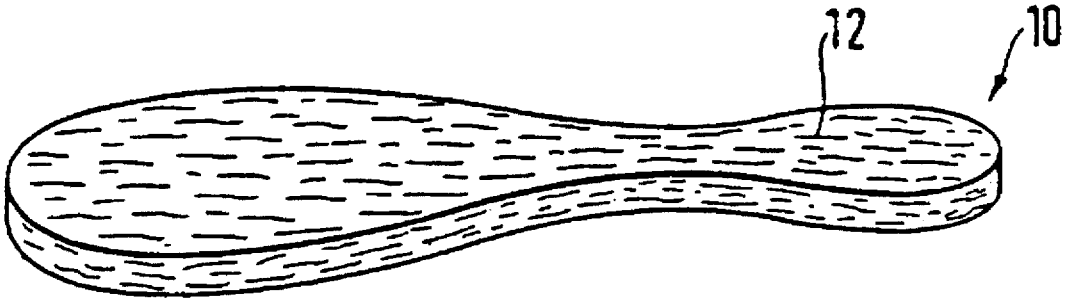

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–10 are cancelled.

* * * * *